US005271678A

United States Patent [19]

Bourgeot

[11] Patent Number: 5,271,678

[45] Date of Patent: Dec. 21, 1993

[54] ELASTIC BEARING

[75] Inventor: Jacques Bourgeot, Taverny, France

[73] Assignee: Caoutchouc Manufacture Et Plastiques S.A., Versailles, France

[21] Appl. No.: 943,439

[22] Filed: Sep. 10, 1992

Related U.S. Application Data

[63] Continuation of Ser. No. 635,961, Dec. 28, 1990, Pat. No. 5,150,657.

[30] Foreign Application Priority Data

Dec. 29, 1989 [FR] France ..... 89 17531

[51] Int. Cl.[5] ..... F16C 27/06; B61D 17/00; B61G 5/02

[52] U.S. Cl. ..... 384/221; 105/3; 105/4.1; 213/75 R; 267/140.4

[58] Field of Search ..... 384/222, 221, 215; 267/141.3, 141.1, 141.7; 416/134 R; 248/603, 634, 632; 105/3, 4.1, 4.3, 199.4; 213/7, 75 R

[56] References Cited

U.S. PATENT DOCUMENTS

| | | | |
|---|---|---|---|
| 2,150,896 | 3/1939 | Muchnic | 105/199 |
| 3,667,820 | 6/1972 | Sherrick . | |
| 3,679,197 | 7/1972 | Schmidt | 384/215 X |
| 4,108,508 | 8/1978 | Clinard, Jr. | 384/221 |
| 4,349,184 | 9/1982 | Peterson et al. | 267/153 |
| 4,435,097 | 3/1984 | Peterson | 384/221 |
| 4,942,824 | 7/1990 | Cros | 105/4.3 |

FOREIGN PATENT DOCUMENTS

| | | |
|---|---|---|
| 0343482 | 11/1989 | European Pat. Off. . |
| 2357409 | 2/1978 | France . |
| 2631917 | 12/1989 | France . |
| 340525 | 11/1955 | Switzerland . |
| 1504137 | 8/1989 | U.S.S.R. . |

*Primary Examiner*—Thomas R. Hannon
*Attorney, Agent, or Firm*—Thomas N. Ljungman

[57] ABSTRACT

Elastomeric rubber bearing for being connected between two bodies. The bearing employs an element having a series of resilient elements connected together by a series of interposed rigid elements. The thickness of the resilient elements and the width of the cross-section of the resilient and rigid elements vary in relation to the position of the elements.

14 Claims, 4 Drawing Sheets

FIG. 3a

| Ref. No. | ~ Angle |
|---|---|
| 26 | 24° – 26° |
| 27 | 24° – 26° |
| 28 | 48° – 52° |

FIG. 3b

| Ref. Letter | ~ Thickness of Layer (mm) | ~ Average Radius of Layer (mm) |
|---|---|---|
| 7a | 11.2 | Ra=116 |
| 7b | 10.1 | Rb=128 |
| 7c | 9.1 | Rc=143 |
| 7d | 8.3 | Rd=157 |
| 7e | 7.8 | Re=167 |
| 7f | 7.4 | Rf=176 |
| 7g | 7.1 | Rg=183 |

ELASTIC BEARING

This application is a continuation of U.S. patent application Ser. No. 07/635,961, which was filed on Dec. 28, 1990, U.S. Pat. No. 5,150,657.

BACKGROUND OF THE INVENTION

1. Field of the Invention

This invention relates to an elastic bearing, more particularly, to an elastic bearing for being connected between two bodies. The bearing is formed or constructed of resilient or elastomeric elements.

2. Background Information

An elastic, elastomeric, or rubber bearing connecting a first body and a second body may employ a rounded or spherical ball and socket joint to link one body to the other. One of the bodies may have a portion of the joint positioned around a portion of the joint of another body. Such bearings support a high load by means of an elastomeric mechanism that is sandwiched between armature members. The bearings employ intermediate armature members such as hoops, and the assembly of elastomeric elements and hoops may be prestressed as necessary. Therefore, they require a great deal of machining and cost a great deal to manufacture on account of their significant rigidity, even though they provide rather low anti-vibration filtering.

French Patent having Publication No. 2,357,409 and Patent No. 76 20867 to SOCIETE GENERALE DE CONSTRUCTIONS ELECTRIQUES ET MECANIQUES ALSTHOM recites several separate bearing articulations around two vertical axes and a horizontal axis. The bearing articulations are all integrated with a gangway compartment. This arrangement may be employed if the interconnected bodies are roll-linked by a system employing universal joints.

With this arrangement, the elastomer mechanism which bears a load, or weight, is limited to rotations around one, or possibly both, vertical axes connecting one body and at least a portion of the other. The execution of movement between the two bodies usually requires only one-half of the angle between the bodies, since a portion of one of the bodies bisects the angle by its horizontal axis. Under these circumstances, consequently, the articulation needs to provide only limited performance requirements. However, the device disclosed in this patent is limited to arrangements having two inseparable bodies.

French Patent having Publication 2,631,917 and Patent No. 88 06878 to SOCIETE GENERALE DE CONSTRUCTIONS ELECTRIQUES ET MECANIQUES ALSTHOM discloses a device that is satisfactory for use in a succession of adjacently disposed bodies. The joint between bodies includes an annular portion with a truncated conical surface. Also provided is an enveloping support piece that is connected to one of the bodies. The joint also includes an annular articulation element that is made of resilient or elastomer composite material. The joint further includes metal plates that are positioned between layers of elastomeric material and the joint is surrounded by and in contact with the external truncated conical surface. This patent publication also discloses an alternate embodiment in which the metal plates and the layers of resilient material have the shape of a spherical sector.

OBJECT OF THE INVENTION

The object of the present invention is to provide an optimized bearing, or joint, that may be employed to connect together two bodies. The optimization of the joint is a function of the number and the angular arrangement of the layers of resilient or elastomeric material and is governed by the laws of physics and the physical properties that dictate their relative dimensions.

SUMMARY OF THE INVENTION

Accordingly, the invention relates to a joint connecting two bodies. The joint includes layers of resilient or elastomeric elements that are interposed between a support piece and an internal armature. The support piece may be permanently connected to one of the bodies and the internal armature may have a surface connected to the second body. The joint is also constructed with truncated metal hoops positioned between the layers of the resilient or elastomeric compound or material.

Preferably, the joint is formed of seven layers of an elastomeric, or resilient, compound or material. Preferably one of six truncated conical metal hoops is positioned between each adjacent pair of the elastomeric or resilient layers. All six hoops are, preferably, of equal thickness. Each layer of elastomeric or resilient compound has, generally, a constant thickness throughout the layer, although the thickness of each individual layer is different from the thickness of each other layer. Each layer of elastomeric or resilient material in the joint is in the form of a truncated cone and each hoop is in the form of a truncated cone.

The internal armature which is connected to the innermost elastomeric or resilient layer, and the external armature which has a cross-section that may be in the shape of a right triangle, are intimately bonded by adherization to their corresponding elastomer or resilient layer as the elastomer or resilient layer is vulcanized or cross-linked. The angle of the truncated conical surfaces of the elastomeric or resilient layers and the hoops is approximately twenty-five degrees relative to the axis of articulation of the bodies.

In summary, one feature of the invention resides broadly in an elastic bearing comprising: a resilient member; first attaching means for attaching a first body to the resilient member; second attaching means for attaching a second body to the resilient member; the resilient member comprising: a plurality of resilient elements and a plurality of rigid elements; the plurality of resilient elements being alternately positioned relative to the plurality of rigid elements such that each adjacent pair of resilient elements is separated by one rigid element; the plurality of resilient elements and the plurality of rigid elements defining a symmetrical axis; each resilient element defining an average radius measured from the symmetrical axis; the plurality of resilient elements and the plurality of rigid elements comprising truncated conical elements; each resilient element being configured to define a linear dimension along a straight line segment of its conical surface, such linear dimension of each resilient element having a magnitude inversely related to the square of its corresponding average radius; and each resilient element defining a generally constant thickness having a magnitude inversely related to its corresponding average radius.

BRIEF DESCRIPTION OF THE DRAWINGS

The following Description of the Preferred Embodiments may be better understood when taken in conjunction with the appended drawings in which:

FIG. 3*a* is a table of some of the geometrical parameters of FIG. 2 showing relative angular relationships between the surface of the interior armature of the present invention and the axis of articulation of corresponding adjacent railway cars;

FIG. 3*b* is a table of some of the geometric parameters of FIG. 2 showing the relationship between the average radius of the layers of resilient material of the present invention and the thickness of the corresponding layers;

DESCRIPTION OF THE PREFERRED EMBODIMENTS

Figure 1:
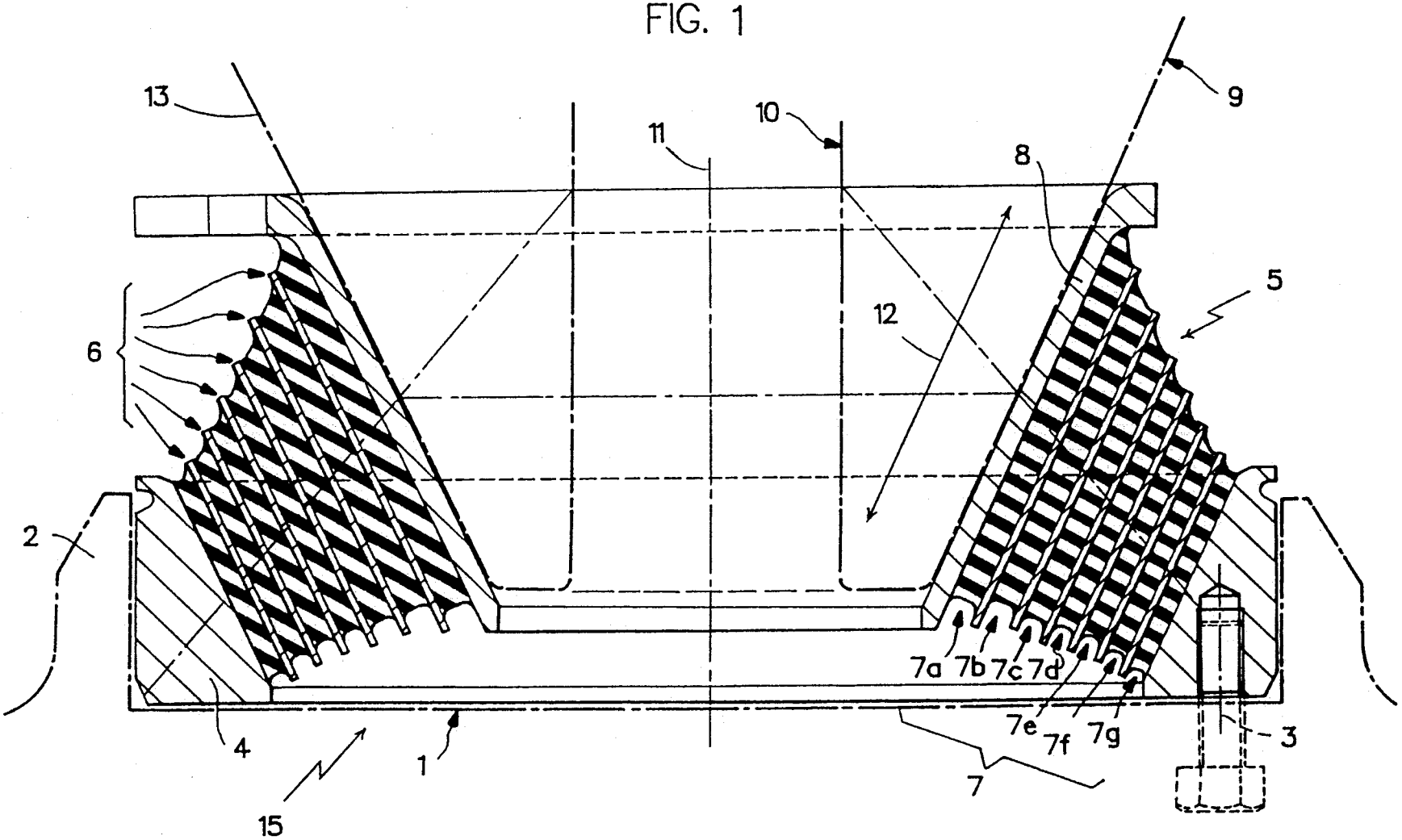
FIG. 1 is a partial cross-section of the present invention.
Figure 2:
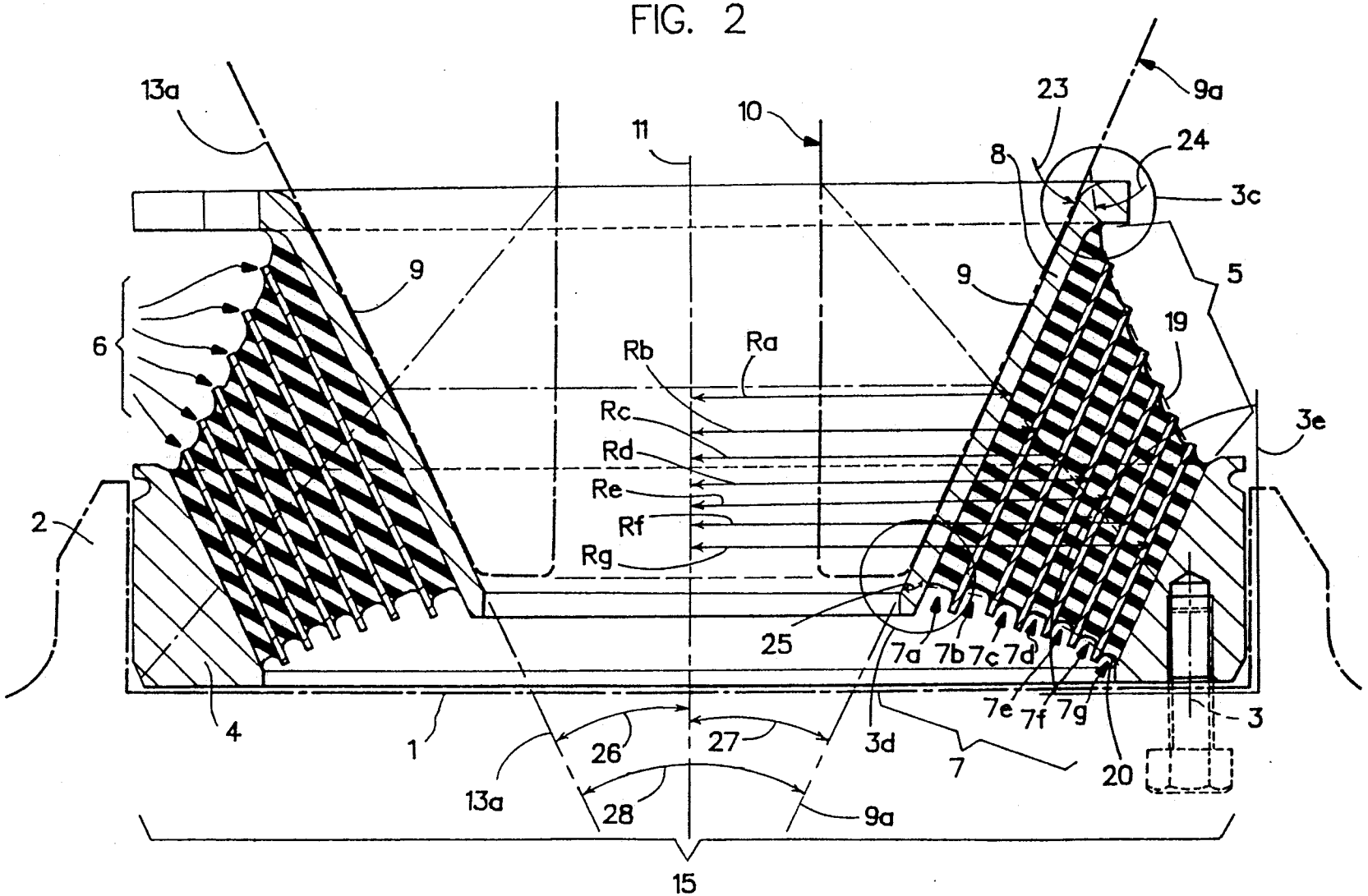
FIG. 2 is a partial cross-section of the present invention as shown in FIG. 1 with additional geometrical parameters presented thereon.

FIGS. 1 and 2 show plate 1 which may form an integral part of a first vehicle. Plate 1 has a cylindrical, vertical raised edge portion 2. Raised edge portion 2 is fastened, for example by bolts such as bolt 3, to external armature 4. External armature 4 may have a right-triangle cross-section and may support element 5. Element 5 is the resilient device defined by the present invention.

Element 5 may include six metal hoops 6 that may be of equal thickness and shaped in the form of truncated cones. Metal hoops 6 are preferably made of welded, rolled sheet steel. One of each metal hoop 6 is sandwiched between adjacent pairs of layers of resilient or elastomeric material or compound *7a*, *7b*, *7c*, *7d*, *7e*, *7f* and *7g* (which are referred to hereinafter as layers 7). Layers 7 are, preferably, made of natural or synthetic rubber or polyisoprene based compounds and have great resilience as well as resistance to alternating fatigue. The properties of the compound or material from which layers 7 are formed may be enhanced by the selection of appropriate additives or fillers for reinforcement.

In a manner similar to the way external armature 4 serves as a support in contact with plate 1, internal armature 8, having contact surface 9, is connected during operation to the lower portion of annular part 10. Annular part 10 may be permanently connected to the adjacent, second vehicle.

External armature 4, internal armature 8 and each of metal hoops 6 are securely bonded to layers 7 by the physical-chemical phenomenon called "adherization" which may take place during vulcanization. Metal hoops 6 and layers 7 are in the shape of truncated cones which may be adherized to one another.

A good quality of adherization is conventionally obtained when, during a destructive tensile test, a rupture occurs in the resilient or elastomeric compound rather than when the compound separates from the member to which it is adherized. A "bond test," wherein a tensile stress is applied opposite to the normal load for which the part is designed, makes it possible to verify the absence of damage without destruction.

For reasons of space, internal armature 8, should, preferably, have the smallest possible thickness between contact surface 9 and element 5. Preferably, the thickness between contact surface 9 and element 5 should not exceed the thickness of one of layers 7.

The principal function of the articulated connection or joint, which is the object of the present invention, is to facilitate relative alternating rotation of the vehicles around the central axis of the truncated conical parts. The truncated conical parts may be placed under permanent compression. One purpose of the optimization of the articulated connection or joint is to obtain geometric shear rates within element 5 that are as equal as possible during rotation between the vehicles. To obtain the desired shear rates, it is preferable that each of layers 7 has a torsional rigidity inversely proportional to its thickness. Also, it is preferable that the thickness of each individual layer be constant throughout that individual layer, even though the thickness is different from one of layers 7 to another. Strictly speaking, since the angular rotation is actually the same at each extremity of each layer 7, the shearing of the material, which remains of the same thickness, takes place at a rate which is proportional to the actual radius in every area of each layer 7. Nevertheless, an average shear may be estimated at a rate sensibly equal to the one applied at the average radius. The average radius of one layer 7 is the average of each individual radii of that particular layer 7 as measured from each vertical point along center line 11. The average radius of one layer 7 may, also, be the actual radius of that particular layer 7 measured at the midpoint between two extreme ends of a straight line segment of a conical surface of that layer 7.

The average value of these geometric shear rates, for the average radius of each individual layer 7, can be maintained in the different layers only if the strain is essentially the same and the material has essentially a constant shear modulus. This requires that the cross section, or thickness, of each layer 7 be inversely related or proportional to the average radius of that layer 7. By configuring the layers in this manner, each individual layer of layers 7 is subjected to essentially the same rotational torque along with the resilient or elastomeric connections that are connected in series.

This configuration of the layering is inconsistent with a constant rate of loading under a vertical load, or force, as well as under a horizontal force. Such identical vertical and horizontal loading would require the cross section, or thickness, of each of layers 7 to be equal and the width, or length, of each of layers 7 measured along line 12, to be inversely related or inversely proportional to the average radius. This less penalizing condition need not be satisfied with the same strictness as that dictated by the optimization of the articulation joint or connection as when employed during alternating rotation. The term "width, or length" of layer 7 means the length of that layer 7 along a straight line segment between the exposed, extreme ends of a conical surface of that layer 7.

To satisfy the desired requirement for generally identical rotational torque and generally identical shear rates, in each layer 7 during rotation, the governing law or physical properties for the articulation joint of the present invention recommends a thickness of each of layers 7 that is inversely proportional to the average radius of that particular layer 7 and a width that is inversely proportional to the square of the average radius of that particular layer 7.

The same law governs the width, or length, measured along line 12, of each metal hoop 6, which also is related or proportional to the square of the average radius of each hoop 6. The term "width, or length" of a metal hoop 6 means the length of that hoop 6 along a straight line segment between exposed, extreme ends of a conical surface of that hoop 6. It should be noted that a better homogeneity within each layer 7, to achieve the same geometric shear, would require a thickness of each layer 7 that is related or proportional to the actual radius, thereby requiring each of conical layers 7 to have different conical angles and all of the connecting surfaces between each layer 7 and each hoop 6 to have the same "conical" peak. The selection of identical conical angles for all of metal hoops 6 is, therefore, an approximation that facilitates the limiting of the costs of hoops 6 to realistic values, while maintaining a constant thickness of their plates.

The result of these arrangements, and another object of the present invention, is to provide each layer 7 with a constant form factor and to provide to each one a ratio of rigidities, between pure compression and pure shear, that is constant. The form ratio or factor is a function of the ratio between the connecting surfaces between hoops 6 and layers 7 as well as the exposed surfaces at the extremities of each layer 7.

The vertical axial rigidity, which is primarily due to the projection on the vertical axis of an orthogonal compression of the resilient or elastomeric material, is therefore distributed from one layer 7 to another layer 7 in the same manner as the shear. The resilient or elastic deformations are, therefore, distributed in a manner which is inversely related or proportional to the square of the average radius for each layer 7 under the same axial load in series.

To achieve the optimization of the articulation joint the number of layers required must be carefully selected because a significant cumulative thickness of all of the layers 7 is necessary, but is also limited by the geometry of the space allowed for the device.

In one embodiment, of the present invention, where the diameter of the articulation is 400 millimeters and where the total height in the free state does not exceed 200 millimeters, the cumulative thickness of the layers 7 totals about 61 millimeters and each hoop 6 has a thickness of about 2.5 millimeters. Therefore, the thickness of the articulation measured between facing sides of external armature 4 and internal armature 8 is about 76 millimeters.

Moreover, the same optimization of the articulation joint requires that the angle between either line 13*a* or line 9*a* and the vertical axis of rotation about center line 11 be about 24 degrees to 26 degrees. Therefore, the angle between line 9*a* and line 13*a* will be about 48 degrees to 52 degrees. Lines 9*a* and 13*a* are generally parallel to contact surface 9 and diametrically opposed to one another as shown in FIG. 2.

In the same embodiment, the thickness of each of the layers decreases from the innermost layer 7*a* to the outermost layer 7*g*. The following are representative values of thicknesses of the layers 7*a*–7*g* for one embodiment of the invention:

Layer 7*a* may have a thickness of about 11.2 millimeters.

Layer 7*b* may have a thickness of about 10.1 millimeters.

Layer 7*c* may have a thickness of about 9.1 millimeters.

Layer 7*d* may have a thickness of about 8.3 millimeters.

Layer 7*e* may have a thickness of about 7.8 millimeters.

Layer 7*f* may have a thickness of about 7.4 millimeters.

Layer 7*g* may have a thickness of about 7.1 millimeters.

The employment of more than seven layers would provide a torsional rigidity that would aggravate the non-uniformity of the strains within each layer, produce a higher conical rigidity and would excessively limit the possible rolling movement between the two vehicles.

The employment of a lower number of layers 7 would result in insufficient participation of the orthogonal compression in the different layers due to a reduction of the form factor. A higher shear modulus of the material of the layers, which would allow for compensation for this effect would result in insufficient resistance to alternating fatigue.

For the same reason, it is not appropriate to employ a different shear modulus from one layer 7 to another layer 7. This variant, however, would be possible by forming the layers by compression molding of preforms, which are rather difficult to manufacture on account of the conical shape but, nevertheless, allow for a constant thickness in each layer, with the thicknesses of the layers 7 being different from one layer to another.

With respect to the widths, or lengths of the layers 7, the following are representative ranges for one embodiment of the present invention when the thicknesses of the layers 7 are as stated hereabove:

Layer 7*a* may have an average width, or length of about 168 millimeters.

Layer 7*b* may have an average width, or length of about 136 millimeters.

Layer 7*c* may have an average width, or length of about 111 millimeters.

Layer 7*d* may have an average width, or length of about 92 millimeters.

Layer 7*e* may have an average width, or length of about 81 millimeters.

Layer 7*f* may have an average width, or length of about 73 millimeters.

Layer 7*g* may have an average width, or length of about 67 millimeters.

The most advantageous fabrication process for the construction of the articulation joint or connection according to the present invention is transfer molding. With this process, metal armatures 4 and 8 and hoops 6 are initially treated and coated with the adhesives necessary for the adherization during vulcanization. Armatures 4 and 8 and hoops 6 are then placed in a mold. Each metal hoop 6, therefore, has glue on both sides and armatures 4 and 8 have glue only on the one side designed to be in contact with the adjacent elastomer compound layers 7*g* and 7*a*, respectively.

All the physical-chemical connections are made in this manner, through adherization during vulcanization under controlled conditions of temperature and pressure. The articulation device, after removal of burrs and splinters, is ready for immediate use after unmolding and cooling.

The articulation joint or connection of the present invention allows all of the resilient or elastic deformations of a coupling to occur between adjacent railway vehicles of an articulated train wherein the ends of the adjacent vehicles are positioned on trucks common to the two adjacent vehicles. The articulation joint or connection is optimized for the longest life under dynamic stresses and provides good filtering of parasite vibrations between the vehicles. The present invention provides an efficient and optimal solution to the articulation design necessary in the type of integrated railway train known as an "articulated train," while simplifying the coupling and uncoupling operations of adjacent two vehicles of the train.

FIGS. 3, 3*a*, 3*b*, 3*c*, 3*d* and 3*e* show the geometrical relationships between the various elements of articulation joint 15.

FIG. 3*a* shows relative angular relationships between the surfaces 9 and 13 of the internal armature 8 and the central axis 11.

FIG. 3*b* details the lengths of radii $R_a$, $R_b$, $R_c$, $R_d$, $R_e$, $R_f$ and $R_g$ shown in FIG. 2. Radii $R_{a-g}$ are each measured from center line 11 to the nearer conical surface of its corresponding layer 7*a*–7*g*.

Figure 3D:
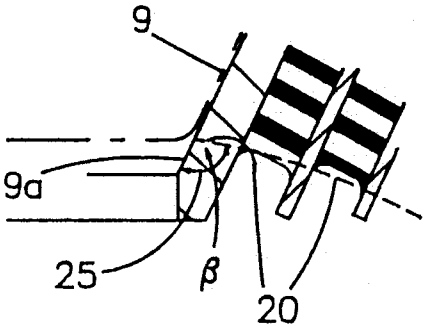
FIG. 3*d* is an enlarged view of the encircled area labelled as 3*d* in FIG. 2.
Figure 3E:
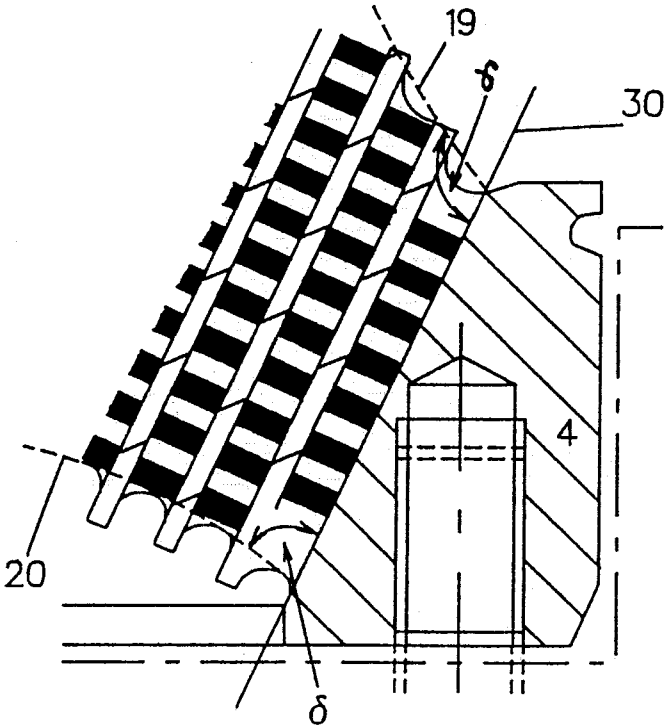
FIG. 3*e* is an enlarged view of the area labelled 3*e* in FIG. 2.
Figure 3C:
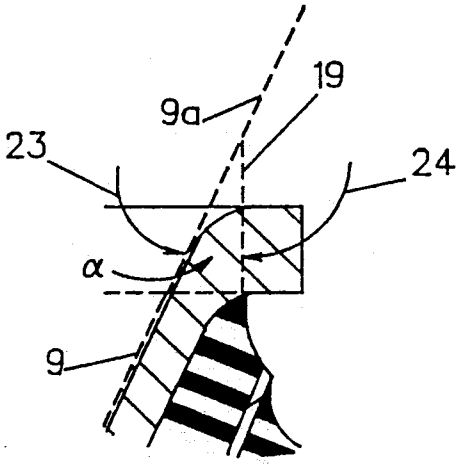
FIG. 3*c* is an enlarged view of the encircled area labelled as 3*c* in FIG. 2.

FIGS. 3*c* and 3*d* are enlarged views of the corresponding encircled portions of FIG. 2. Broken lines 19 and 20, preferably second order curves, have been drawn along the two exposed, extreme ends of layers 7. Line 19 intersects line 9*a* as shown in FIG. 2 and 3*c*. The interior angle $\alpha$ formed between lines 19 and 9*a* (between arrows 23 and 24) is preferably less than 90°, and is most preferably between about 25° to about 40°.

Line 20 also intersects line 9*a* as shown in FIGS. 2 and 3*d* to form angle $\beta$. Line 20 is preferably generally orthogonal to line 9*a*; so that angle $\beta$ is preferably about 90°, in which case angle $\alpha$ is substantially smaller than angle $\beta$.

FIG. 3*e* is an enlarged view of the section 3*e* of FIG. 2. Broken line 19 intersects line 30, drawn along a face surface of armature 4, at an interior angle $\alpha$ which is preferably greater than 90°, and most preferably between about 108° to about 122°. Broken line 20 intersects line 30 at an interior angle $\delta$ which is preferably less than 90°, and most preferably between about 64° to about 80°. Angle $\gamma$ is therefore substantially greater than angle $\delta$.

Additionally, line 9*a* and center line 11 are angularly separated from one another (between the ends of line 27) by about 24°–26° as shown in FIGS. 2 and 3*a*. Further, line 13*a* and center line 11 are angularly separated from one another (between the ends of line 26) by about 24°–26° as shown in FIGS. 2 and 3*a*. Therefore, lines 9*a* and 13*a* are angularly and diametrically separated from one another (between the ends of line 28) by about 48°–52° as shown in FIGS. 2 and 3*a*. As discussed above, lines 9*a* and 13*a* are generally parallel to contact surface 9 and diametrically opposed to one another.

It is to be understood throughout this entire application that numerical or relative values presented herein are only representative examples of embodiments of the present invention and that the claimed invention is not limited only to those numerical or relative values.

In summary, one feature of the invention resides broadly in a coupling articulation between railway vehicles resting on a median truck, connected by means of a resilient or elastomeric element interposed between a support piece (1) which is integral with one of the vehicles, and an internal armature (8) constituting the contact assembly surface (9) of the other vehicle, on the coupling, comprising an element made of resilient or elastomeric composite material (5) formed by alternating layers of metal hoops (6) and elastomer compound (7) characterized by the fact that said element made of resilient or elastomeric composite material (5) is formed of six metal hoops (6) which are alternately layered with seven layers of elastomer compound (7) of constant thickness, the contact surfaces being in the shape of truncated cones.

Another feature of the invention resides broadly in a coupling articulation between railway vehicles which is characterized by the fact that the internal armature (8), which constitutes the assembly contact surface (9) on the annular part (10) is intimately bonded, by adherization during cross-linking to the innermost elastomer compound layer (7*a*) by a contact surface in the form of a truncated cone of the same angle as the assembly contact surface (9), and that said internal armature (8) has a constant thickness which is at the maximum equal to the thickness of the layers of elastomer compound (7).

Yet another feature of the invention resides broadly in a coupling articulation between railway vehicles which is characterized by the fact that the external armature (4), having a right-triangle cross-section, which supports the element made of resilient or elastomeric composite material (5), is intimately bonded, by adherization during cross-linking, to the outermost layer of elastomer compound (7*g*), by its contact surface which is also in the shape of a truncated cone.

A further feature of the invention resides broadly in a coupling articulation between railway vehicles which is characterized by the fact that the variation of the height of the metal hoops (6), and also of the width, or height of the layers of elastomer compound (7) is inversely proportional to the square of their average radius, to promote the most uniform rate of shear possible in torsion loads around the axis of the cones.

A yet further feature of the invention resides broadly in a coupling articulation between railway vehicles which is characterized by the fact that the variation of the thickness of the elastomer compound layers (7) is inversely proportional to their average radius, to balance the torsion torques around the axis of the cones at the most constant value possible between each pair of adjacent, intermediate metal hoops (6).

Yet another further feature of the invention resides broadly in a coupling articulation between railway vehicles which is characterized by the fact that the angle of the truncated cones is approximately twenty-five degrees in relation to the axis of the articulation.

It should be appreciated that this invention also generally relates to a train of railway cars and, more particularly, to an articulated coupling between two railway cars or vehicles that are positioned on a median, or intermediate, truck. The articulated coupling is formed or constructed of resilient or elastomeric elements.

An articulated connection between railway cars or vehicles in articulated trains, where two ends of the cars or vehicles rest on a single median or intermediate truck, may employ a rounded or spherical ball and socket joint to link one vehicle to the other vehicle. One of the vehicles may have a portion of the joint positioned around a portion of the joint of another vehicle to, thereby, control the roll between the two vehicles. Such articulated couplings support a high load by means of an elastomeric mechanism that is sandwiched between armatures. The articulated couplings employ intermediate armatures such as hoops, and the assembly of elastomeric elements and hoops may be prestressed as necessary. Therefore, they require a great deal of machining and cost a great deal to manufacture on account of their significant rigidity, even though they provide rather low anti-vibration filtering.

French Patent having Publication No. 2,357,409 and Patent No. 76 20867 to SOCIETE GENERALE DE CONSTRUCTIONS ELECTRIQUES ET MECANIQUES ALSTHOM recites several separate articulations around two vertical axes and a horizontal axis. The articulations are all integrated with a gangway compartment. This arrangement may be employed if the bodies of two adjacent vehicles are roll-linked by a system employing universal joints.

With this arrangement, the elastomer mechanism which bears the vehicle load, or weight, is limited to rotations around one, or possibly both, vertical axes connecting one vehicle body and one-half of the gangway compartment. The execution of the angular movement between the two vehicles requires only one-half of the angle between the vehicles, since the compartment, which is positioned on the median truck, bisects the angle by its horizontal axis. Under these circumstances, consequently, the articulation needs to provide only limited performance requirements. However, such is not the case for a train with more than two successive vehicles, because no rolling flexibility or track distortion separates them. Therefore, the device disclosed in this patent is limited to tramways or self-propelled trains having two inseparable bodies.

French Patent having Publication 2,631,917 and Patent No. 88 06878 to SOCIETE GENERALE DE CONSTRUCTIONS ELECTRIQUES ET MECANIQUES ALSTHOM discloses a device that is satisfactory for use in a long train. The joint between vehicles, or cars, includes an annular portion with a truncated conical surface. Also provided is an enveloping support piece that is connected to one of the vehicles of the train. The joint also includes an annular articulation element that is made of resilient or elastomer composite material. The joint further includes metal plates that are positioned between layers of elastomeric material and the joint is surrounded by and in contact with the external truncated conical surface. This patent publication also discloses an alternate embodiment in which the metal plates and the layers of resilient material have the shape of a spherical sector.

One object of the present invention is to provide an optimized articulated joint that may be employed to connect together two vehicles, or two articulated vehicles, of a train of railway cars. The two vehicles, or two articulated vehicles, may be supported by a common, median or intermediate truck. The optimization of the joint is a function of the number and the angular arrangement of the layers of resilient or elastomeric material and is governed by the laws of physics and the physical properties that dictate their relative dimensions.

Accordingly, the invention relates to a coupling articulation between two railway vehicles of a train of railway vehicles. The two vehicles may be positioned on a common median, or intermediate truck. The joint includes layers of resilient or elastomeric elements that are interposed between a support piece and an internal armature. The support piece may be permanently connected to one of the vehicles and the internal armature may have a surface connected to the second vehicle. The joint is also constructed with truncated metal hoops positioned between the layers of the resilient or elastomeric compound or material.

Preferably, the joint is formed of seven layers of an elastomeric, or resilient, compound or material. Preferably one of six truncated conical metal hoops is positioned between each adjacent pair of the elastomeric or resilient layers. All six hoops are, preferably, of equal thickness. Each layer of elastomeric or resilient compound has, generally, a constant thickness throughout the layer, although the thickness of each individual layer is different from the thickness of each other layer. Each layer of elastomeric or resilient material in the joint is in the form of a truncated cone and each hoop is in the form of a truncated cone.

The internal armature which is connected to the innermost elastomeric or resilient layer, and the external armature which has a cross-section that may be in the shape of a right triangle, are intimately bonded by adherization to their corresponding elastomer or resilient layer as the elastomer or resilient layer is vulcanized or cross-linked. The angle of the truncated conical surfaces of the elastomeric or resilient layers and the hoops is approximately twenty-five degrees relative to the axis of the articulation of the vehicles.

One aspect of the invention resides broadly in a railway train comprising first and second car bodies. Also included is a truck for supporting the first and second car bodies. Connector apparatus is provided for articulately connecting the first and second car bodies together. The connector apparatus includes a resilient member, a first attaching member for attaching the first car body to the resilient member and a second attaching member for attaching the second car body to the resilient member. The resilient member includes a stack of seven truncated conical, resilient elements and six truncated conical rigid elements. The resilient elements are alternately positioned relative to the rigid elements such that each adjacent pair of resilient elements is separated by one rigid element. The stack defines a symmetrical axis. The resilient elements each define an average radius measured from the symmetrical axis. Each of the resilient elements defines a linear dimension along a straight line segment of its conical surface. Each such linear dimension of each resilient element has a magnitude inversely related to the square of the corresponding average radius of the resilient element. Each of the resilient elements defines a generally constant thickness having a magnitude inversely related to its corresponding average radius.

Thus, in brief summary, an aspect of the present invention is directed to a train of railroad cars having an articulated connection between adjacent railway cars which share a common truck. The articulated connection employs a connecting element having a series of truncated conical resilient elements connected together by a series of interposed truncated conical rigid elements. The thickness of the resilient elements and the width of the cross-section of the resilient and rigid elements vary in relation to the position of the elements.

Some examples of railway cars can be found in U.S. Pat. No. 4,867,071, entitled "Truck-mounted Articulated Connector for Railway Cars"; U.S. Pat. No. 4,644,871, entitled "Articulated Hopper Railcar"; U.S. Pat. No. 4,339,996, entitled "Articulated Railway Car; U.S. Pat. No. 4,258,628, entitled "Articulated Railway Coupling"; U.S. Pat. No. 4,233,909, entitled "Railway Car Assembly Composed of a Series of Articulately Interconnected Cars"; U.S. Pat. No. 4,131,069, entitled "Articulated Railway Car Trucks"; U.S. Pat. No. 3,896,945, entitled "Bottom Dumping Railway Hopper Car"; U.S. Pat. No. 4,869,178, entitled "Device Designed to Ensure Running Continuity Between Two Successive Railroad or Road Vehicles"; and U.S. Pat. No. 4,697,526, entitled "Articulation System for Articulated Depressed-Floor Tramway Carriages".

All, or substantially all, of the components and methods of the various embodiments may be used in any combination with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. An elastic bearing comprising:

a resilient member;

first attaching member for attaching a first body to said resilient member;

second attaching means for attaching a second body to said resilient member; and said resilient member comprising:

a plurality of resilient elements and a plurality of rigid elements;

said plurality of resilient elements being alternately positioned relative to said plurality of rigid elements such that each adjacent pair of resilient elements is separated by one rigid element;

said plurality of resilient elements and said plurality of rigid elements defining a symmetrical axis;

each said resilient element defining an average radius measured from said symmetrical axis;

said plurality of resilient elements and said plurality of rigid elements comprising truncated conical elements;

each said resilient element being configured to define a linear dimension along a straight line segment of its conical surface, such linear dimension of each said resilient element having a magnitude inversely related to the square of its corresponding average radius;

each said resilient element defining a generally constant thickness having a magnitude inversely related to its corresponding average radius;

each said linear dimension of each said resilient element having two extreme ends and a midpoint between the two extreme ends;

each average radius of each said resilient element being a radius measured from the midpoint of said linear dimension to said symmetrical axis; and each said resilient element being configured to define a generally constant thickness having a magnitude inversely related to its corresponding average radius as 1/R where R is the corresponding average radius.

2. The bearing according to claim 1, wherein said resilient member comprises a stack of seven truncated conical resilient elements and six truncated conical rigid elements.

3. The bearing according to claim 2, wherein each said rigid element is adherized to two said resilient elements.

4. The bearing according to claim 3, wherein:

said first attaching means is a first armature; and said first armature has a cross section defining a portion of a right triangle.

5. The bearing according to claim 4, further comprising:

said second attaching means being a second armature;

said first armature being adherized to said resilient member; and said second armature being adherized to said resilient member.

6. The bearing according to claim 5, wherein said straight line segment defined by the conical surface of said second armature is angularly separated from a line defined by and parallel to said symmetrical axis by an angle of about 25°.

7. The bearing according to claim 6, wherein:

said second armature is bonded by adherization of said conical surface of said second armature to said first resilient element;

said second armature has a constant thickness which is at the maximum equal to the thickness of said first resilient element;

said first armature supports said resilient member and is bonded by adherization of said inner surface of said first armature to said seventh resilient element; and each of said metal hoops defines a linear dimension along a straight line segment of its conical surface, such linear dimension of each said metal hoop having a magnitude inversely proportional to the square of its average radius.

8. The bearing according to claim 7, further comprising:

said first armature having an inner surface which defines a portion of a truncated cone;

a cross section of said second armature defining a portion of a truncated cone;

said resilient elements having opposite exposed ends, a first set of said exposed ends generally having a greater radius measured to said symmetrical axis than a second set of said exposed ends;

each set of said exposed ends defining a line thereacross;

a first of said lines being defined in a radial direction across said first set of said exposed ends;

said first line intersecting a straight line segment defined by the conical surface of said second armature at a first angle, said first angle being within said resilient member;

a second of said lines being defined in a radial direction across said second set of said exposed ends;

said second line intersecting said straight line segment defined by the conical surface of said second armature at a second angle, said second angle being outside of said resilient member and between said second armature and said first armature;

said second angle being about a right angle; and said first angle being substantially smaller than said second angle.

9. The bearing according to clam 8, further comprising:

said first line intersecting a straight line segment defined by the inner surface of said first armature at a third angle, said second line intersecting said straight line segment defined by the inner surface of said first armature at a fourth angle; and said third angle being substantially greater than said fourth angle.

10. The bearing according to claim 9, wherein:

said first angle is between about 25° to about 40°;

said second angle is about 90°;

said third angle is between about 108° to about 122°; and said fourth angle is between about 64° to about 80°.

11. The bearing according to claim 10, wherein:

at least one of said resilient elements is constructed of at least one of:

a) polyisoprene, b) natural rubber, and c) synthetic rubber; and said rigid elements are constructed of rolled sheet steel.

12. The bearing according to claim 11, wherein:

said thickness of a first of said resilient elements is about 11.2 millimeters;

said thickness of a second of said resilient elements is about 10.1 millimeters;

said thickness of a third of said resilient elements is about 9.1 millimeters;

said thickness of a fourth of said resilient elements is about 8.3 millimeters;

said thickness of a fifth of said resilient elements is about 7.8 millimeters;

said thickness of a sixth of said resilient elements is about 7.4 millimeters;

said thickness of a seventh of said resilient elements is about 7.1 millimeters; and each rigid element has a thickness of about 2.5 millimeters.

13. The bearing according to claim 12, wherein said bearing comprises a coupling for articulately connecting the first body and the second body.

14. The bearing according to claim 13, wherein:

said linear dimension of said first of said resilient elements is about 168 millimeters;

said linear dimension of said second of said resilient elements is about 136 millimeters;

said linear dimension of said third of said resilient elements is about 111 millimeters;

said linear dimension of said fourth of said resilient elements is about 92 millimeters;

said linear dimension of said fifth of said resilient elements is about 81 millimeters;

said linear dimension of said sixth of said resilient elements is about 73 millimeters;

said linear dimension of said seventh of said resilient elements is about 67 millimeters.

* * * * *

UNITED STATES PATENT AND TRADEMARK OFFICE

CERTIFICATE OF CORRECTION

PATENT NO. : 5,271,678

DATED : December 21, 1993

INVENTOR(S) : Jacques BOURGEOT

It is certified that error appears in the above-indentified patent and that said Letters Patent is hereby corrected as shown below:

In column 7, line 37, after 'angle' delete "α" and insert -γ-.

In column 14, line 28, Claim 14, after 'millimeters;' insert --and--.

Signed and Sealed this

Fifteenth Day of October, 1996

Bruce Lehman

*Attest:*

BRUCE LEHMAN

*Attesting Officer*

*Commissioner of Patents and Trademarks*